United States Patent [19]

Bucher

[11] 4,023,598

[45] May 17, 1977

[54] JACQUARD LIFTING WIRE

[75] Inventor: Robert Bucher, Winterthur, Switzerland

[73] Assignee: Sulzer Brothers Limited, Winterthur, Switzerland

[22] Filed: Jan. 20, 1976

[21] Appl. No.: 650,725

[30] Foreign Application Priority Data

Jan. 31, 1975 Switzerland ..... 1199/75

[52] U.S. Cl. ..... 139/59; 139/65

[51] Int. Cl.[2] ..... D03D 3/00; D03D 3/08

[58] Field of Search ..... 139/59–65, 139/85, 86

[56] References Cited

UNITED STATES PATENTS

| | | | |
|---|---|---|---|
| 3,455,339 | 7/1969 | Seiler | 139/59 |
| 3,884,272 | 5/1975 | Brenner et al. | 139/59 |

FOREIGN PATENTS OR APPLICATIONS

| | | | |
|---|---|---|---|
| 75,878 | 6/1894 | Germany | 139/65 |
| 49,281 | 7/1969 | Germany | 139/85 |
| 475,528 | 11/1952 | Italy | 139/59 |
| 1,444 | 9/1889 | Switzerland | 139/59 |
| 4,095 | 1877 | United Kingdom | 139/59 |
| 11,164 | 1891 | United Kingdom | 139/62 |

*Primary Examiner*—James Kee Chi

*Attorney, Agent, or Firm*—Kenyon & Kenyon Reilly Carr & Chapin

[57] ABSTRACT

The lifting wires are provided with a reinforcement within the pressing zone to rigidify the wires while the hook-containing zones remain bendable. The reinforcement is in the form of webs secured to the wires, widened portions of the wires, or a bowed member secured to the pressing member, i.e. jacquard needle, and pivotally articulated at the ends of the lifting wire.

7 Claims, 4 Drawing Figures

JACQUARD LIFTING WIRE

This invention relates to a jacquard lifting wire.

As is known, the lifting wires of a jacquard machine are used to move the healds of a weaving machine. For this purpose, the wires generally have a hook for engaging a griffe, a stop hook which cooperates with a stationary stop member and a pressing zone between the hooks within which a pressing element of the jacquard machine can press against the wire to move the wire transversely. In addition, the lifting wires have had one or two arms. Heretofore, lifting wires of this type have been made of round wire or flat steel and have generally had the same cross-section, i.e. wire-like or flat, over the whole length of the arms. During use, these lifting wires of wire-type tend to vibrate to a considerable degree transversely of their length or to become permanently deformed whereas the flat steel-type remain relatively rigid throughout their length.

The particular property associated with each of these two kinds of lifting wire is manifest to the same extent over the whole length of the lifting wire. This, however, is an undesirable feature since the operation of the lifting wires may become unreliable, particularly where they are to engage with the griffes.

Jacquard lifting wires must meet contrary requirements for reliable operation. On the one hand, some ability to bend resiliently is desirable in the hook zone of a lifting wire so as to reduce permanent deformations and to ensure reliable coupling. However, the ability to bend must not cause excessive vibrations when the lifting wire is pressed abruptly. That is, for pressing, the lifting wire must be fairly rigid.

Accordingly, it is an object of the invention to provide optimum bendability and rigidity in a jacquard lifting wire for the use of the wire in a jacquard machine.

It is another object of the invention to provide an improved lifting wire for use in a jacquard machine.

Briefly, the invention provides a lifting wire for a jacquard machine which possesses dual characteristics of bendability in a hook zone and rigidity in a pressing zone. Generally, the lifting wire has a first hook for engagement with a griffe, a stop hook for engagement with a stationary stop member and a pressing zone for a pressing element of a jacquard machine disposed between the hooks. In one embodiment, the lifting wire is provided with a reinforcement located within the pressing zone to strengthen the wire in the direction of pressing. In another embodiment, the reinforcement is in the form of a bowed member which is secured to the pressing element and pivotally articulated at the ends to the lifting wire within the pressing zone.

The effect of reinforcing the lifting wire only in the pressing zone is that the lifting wire is relatively resilient and relatively readily bendable in its hook zones. Thus, the hooks may remain in engagement with the griffe or stop member, and not experience permanent deformation, during the pressing of the lifting wire. Also, vibrations in the hook zone of the lifting wire immediately after the abrupt onset of pressing is obviated. Thus, a lifting-wire hook which has been disengaged by pressing cannot re-engage accidentally with a griffe in a subsequent operation.

Another effect of the reinforcement of the liftingwire is that a lifting wire is pressed, i.e. moved, to substantially the same distance over the whole of the pressing zone, irrespective of where the associated jacquard needle engages within the pressing zone. Consequently, the bending and vibration conditions at the drive hooks of the various lifting wires are substantially the same irrespective of vertical differences between the place where the needle engages with the strengthened zone of the lifting wire.

These and other objects and advantages of the invention will become more apparent from the following detailed description and appended claims taken in conjunction with the accompanying drawings in which:

Figure 1:
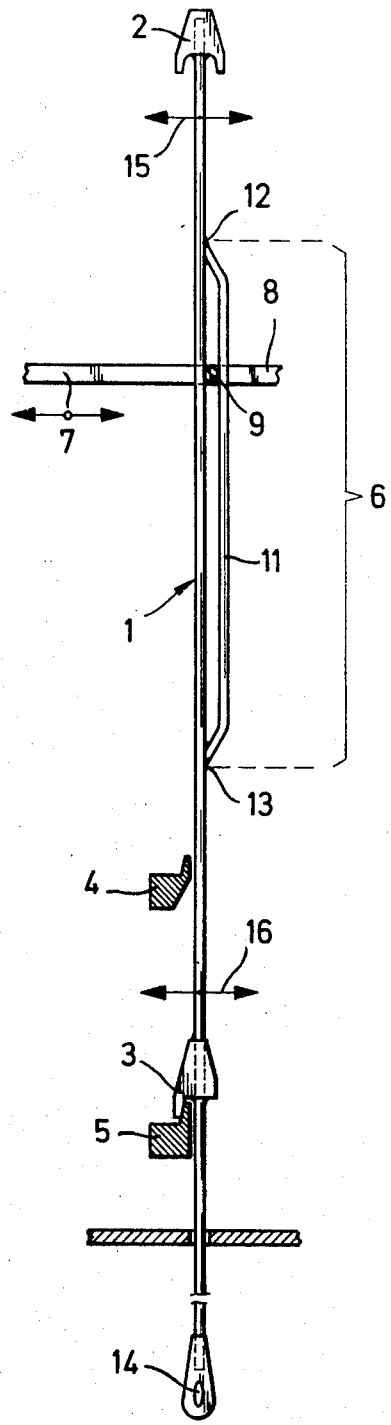
FIG. 1 illustrates a view of a reinforced jacquard lifting wire according to the invention.

Referring to FIG. 1, the jacquard lifting wire (i.e. hook) 1 which is to be used for moving a heald (not shown) of a weaving machine is made of steel wire. The lifting hook 1 includes a double-entraining or driving hook (i.e. neb) 2 at the top end, as viewed, for engagement with vertically reciprocating griffes (not shown) or lifting bars (not shown) disposed to the right and left of the wire 1. In addition, the lifting wire 1 has a stop hook (i.e. neb) 3 at the bottom for alternate engagement with one of a pair of stationary stop members in the form of an open-shed blade 4 and a bottom blade 5.

The lifting wire 1 cooperates with a pressing element such as a jacquard needle 8, which is reciprocable in the direction indicated by a double arrow 7 and which engages the lifting wire 1 in a central zone 6 between the hooks 2 and 3. The needle 8 has a pin or stud or the like 9 engaging between the wire 1 and a stiffening or reinforcing means such as a web 11 mounted on the wire 1. This web 11 is in the form of a wire and disposed in the pressing plane, i.e. in the plane of the drawing, and is connected, e.g. by soldering, to the wire 1 at two spaced apart locations 12, 13 in order to increase the moment of inertia of the cross-section of the lifting wire 1 over the central zone 6. The web 11 thus increases the resistance of the wire 1 to bending in the plane in which the wire 1 is moved by the needle 8.

The lifting wire 1 shown in FIG. 1 is a single wire (one-armed wire) which, at the bottom end below the stop hook 3, extends through a perforate plate or bottom board 19. And carries an eye 14 at the bottom end which is adapted to receive a harness cord to which a heald of a weaving machine is secured.

In operation, the top part of the wire 1, comprising the hook 2, can be bent fairly readily in the pressing plane (the plane of the drawing) as indicated by a double arrow 15, because of its relatively considerable resilience, yet does not acquire any unwanted permanent deformation. Similar considerations apply in the bottom zone of the hook 3 and of the stop members 4, 5 where the lifting wire 1 can make resilient movements as indicated by a double arrow 16. However, because of the presence of the web or member 11, the central pressing zone 6 of the wire 1 is relatively rigid. Thus, the transverse movement which the jacquard needle 8 makes in the direction indicated by the arrow 7 always has the same effect, irrespective of whether the wire 1 is exactly in the bottom-shed position shown or in a higher position or in the top-shed position, and irrespective of whether the needle 8 engages with the bottom or central or top part of the pressing zone 6.

Figure 2:
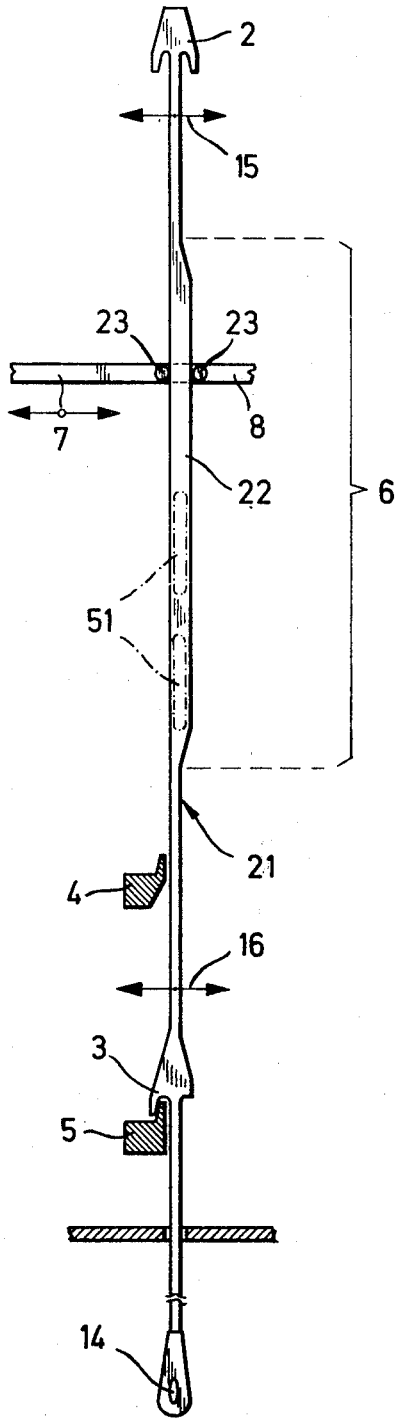
FIG. 2 illustrates a modified lifting wire according to the invention having a widened portion in the pressing zone.

Referring to FIG. 2, a lifting wire (i.e. hook) 21 made of flat steel and having a major surface disposed in the plane of the drawing has a pressing zone 6 reinforced by a widened portion 22. The needle 8 of the jacquard machine engages this widened portion 22 by way of two studs or pins or the like 23 secured on the needle astride the flat lifting wire. The effect as regards flexibility near the hooks, 2, 4, 5 and stiffness in the pressing zone 6 are similar to the case of the wire 1 of FIG. 1. If required, the lifting wire 21 can be formed with weight-reducing apertures 51 as indicated in the widened portion 22.

Figure 3:
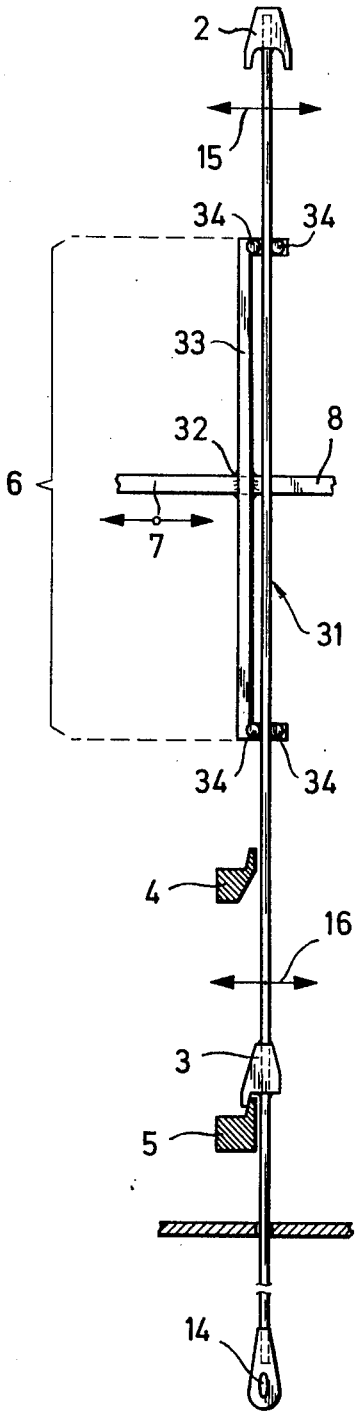
FIG. 3 illustrates a view of a lifting wire reinforced by a bowed member on a pressing element according to the invention.

Referring to FIG. 3, a lifting wire 31 made of steel wire like the wire 1 of FIG. 1 may also be reinforced, i.e. stiffened, via the pressing element 8. To this end, a bowed member 33 is secured at an intermediate point 32, e.g. by welding, to the needle 8 and is pivotally articulated at the top and bottom ends, by way of two pins or studs or the like 34, to the lifting wire 31 so that the lifting wire 31 can be shifted as indicated by the double arrow 7.

Figure 4:
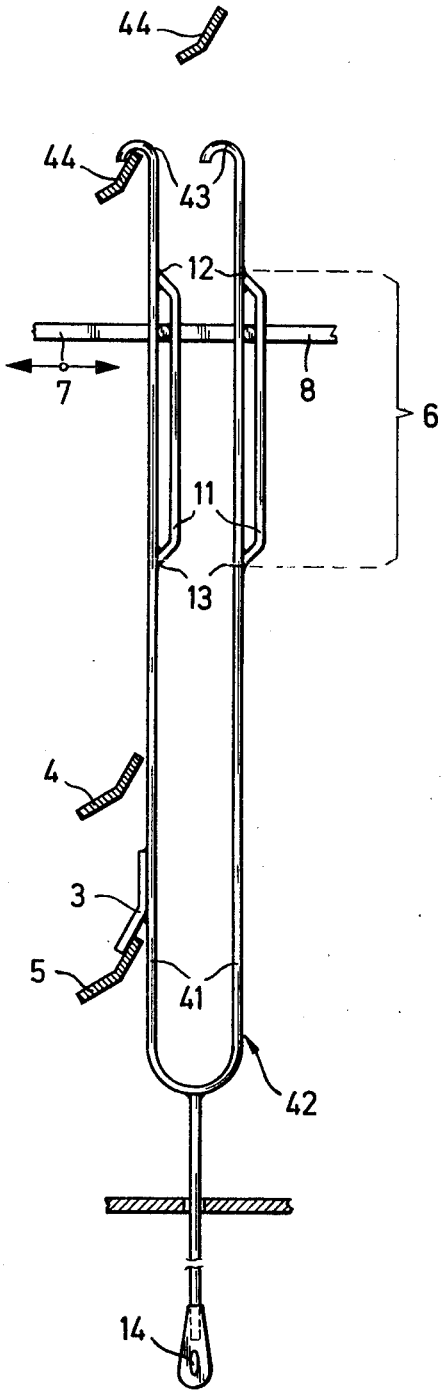
FIG. 4 illustrates a double-arm lifting wire constructed in accordance with the invention.

Referring to FIG. 4, the lifting wire may be in the form of a double lifting wire 42 which has two arms 41 and which is made of steel. As shown, each arm 41 has a reinforcing means such as a web 11 which extends over the pressing zone 6 to reinforce the arm 41 within the pressing zone 6 in the transverse direction. At the top, each arm 41 has a driving or entraining hook 43 adapted to cooperate with various griffes 44. A stop hook 3 is also located at the bottom of the lifting wire 42 which cooperates with the stationary stop members 4, 5.

Reference is made to U.S. Pat. applications Ser. Nos. 650,697; 650,769 and 650,770, each filed Jan. 20, 1976 for various uses of the lifting wires above described.

What is claimed is:

1. The combination of a perforate bottom board;

a jacquard lifting wire for moving a heald of a weaving machine, said wire having a first hook for engagement with a griffe, a stop hook for engagement with a stationary stop member, said hook being disposed in spaced apart relation and a bottom end below said hooks extending through said board;

a pressing element for pressing against said wire within a pressing zone between said hooks to press said wire in a transverse direction; and a reinforcing means for reinforcing said wire within said pressing zone and in said transverse direction.

2. The combination as set forth in claim 1 wherein said reinforcing means is a web secured to said wire at two spaced apart locations.

3. The combination as set forth in claim 1 wherein said reinforcing means is a widened portion of said wire.

4. The combination as set forth in claim 3 wherein said widened portion includes weight-reducing apertures therein.

5. The combination as set forth in claim 1 wherein said reinforcing means includes a bowed member secured at an intermediate point thereof to said pressing element and pivotally articulated at respective ends thereof to said wire.

6. The combination of a perforate bottom board;

a jacquard lifting wire for moving a heald of a weaving machine, said wire having a pair of arms, a stop hook for engaging a stationary stop member, a hook on each arm for engaging a griffe and a bottom end below said stop hook extending through said board;

a pressing element for pressing against each said arm within a respective pressing zone between each griffe-engaging hook and said stop hook to press each respective arm in a transverse direction; and a reinforcing means on each arm for reinforcing each arm within said pressing zone and in said transverse direction.

7. The combination as set forth in claim 6 wherein said reinforcing means is a web secured to each respective arm at two spaced apart points and wherein said pressing element includes a pair of pins, each pin being located between a respective arm and web.

* * * * *